United States Patent [19]

Reid, Jr.

[11] Patent Number: 4,579,230

[45] Date of Patent: Apr. 1, 1986

[54] ENDOSCOPE RACK

[76] Inventor: Ben A. Reid, Jr., Suburban Medical Plz., Suite 2-F, 4001 Dutchmans La., Louisville, Ky. 40207

[21] Appl. No.: 573,380

[22] Filed: Jan. 24, 1984

[51] Int. Cl.[4] ..... A47F 7/00

[52] U.S. Cl. ..... 211/13; 248/89; 248/309.1

[58] Field of Search ..... 211/13, 70.6, 71, 126; 248/89, 309.1, 75; 128/4; 294/74

[56] References Cited

U.S. PATENT DOCUMENTS

| | | | |
|---|---|---|---|
| 355,924 | 1/1887 | Favel | 248/89 |
| 2,845,206 | 7/1958 | Currie | 248/309.1 X |
| 3,627,248 | 12/1971 | Nelson | 248/309.1 |
| 3,941,412 | 3/1976 | Carpenter | 248/75 X |
| 4,022,194 | 5/1977 | Banez | 128/4 |
| 4,240,475 | 12/1980 | Schulz | 248/75 X |
| 4,313,537 | 2/1982 | Collet | 248/309.1 X |
| 4,436,267 | 3/1984 | Eads et al. | 248/89 X |

*Primary Examiner*—Ramon S. Britts
*Assistant Examiner*—Sarah A. Lechok Eley
*Attorney, Agent, or Firm*—Larson and Taylor

[57] ABSTRACT

A rack for storing an endoscope having a control section, an insertion tube, and an universal tube is disclosed. The rack includes a planar base which is disposed generally vertically. An irregularly shaped rest extends perpendicularly from one face of the base and includes a generally straight front portion extending upwardly from the bottom front of the base to a position below the top of the base and a generally convex portion extending downwardly from the upper end of the front portion to the bottom rear of the base. A vertically disposed planar cover is spaced from the planar base by the rest. This cover extends vertically above the rest so that a snug holder for the endoscope is provided with the control section resting against the front portion and the universal tube draping over the convex portion. With this construction, the insertion tube hangs substantially vertically from the control section and the remainder of the universal tube also hangs substantially vertically. Preferably, the convex portion includes a precisely configured top portion adjacent the front portion which supports the weight of the endoscope, this top portion is offset slightly from horizontal, and the front portion is offset somewhat from vertical. A holding device also extends from the other face of the base for holding accessories of the endoscope.

14 Claims, 6 Drawing Figures

ENDOSCOPE RACK

FIELD OF THE INVENTION

The present invention relates generally to racks for delicate instruments, and more particularly to a rack for an endoscope.

BACKGROUND OF THE INVENTION

The advent of flexible endoscopy became possible with the development of flexible glass fibers that carry light through a scope to the viewing area for illumination and back from the viewing area to give the examiner a visual image. Typically, such an endoscope includes an universal tube, a control section, and an insertion tube. The universal tube contains a number of open channels which are appropriately connected at one end of the universal tube to a source of water, air, and suction. The universal tube also contains two glass fibers or optic fibers which are connected to a light source. The other end of the universal tube is connected to the control section which controls the application of water, air, or suction to corresponding channels provided in the insertion tube. The insertion tube also contains glass fibers for transmitting the light from the glass fibers in the universal tube to the site inside the patient. An imaging fiber is also provided in the insertion tube from the end of the insertion tube to an eyepiece on the control suction.

The useful life of such an endoscope is frequently determined by the life of the glass fibers. These glass fibers fatigue and break with age and usage. The glass fiber connected to the eyepiece in the insertion tube is the most critical because it is used for carrying the image. The glass fibers in the insertion tube used for illumination are also important, but there are two such glass fibers and some minor blockage results only in somewhat reduced illumination. In the same manner, the glass fibers carrying illumination in the universal tube are also important but can function with some blockage. The patency of the open channels carrying water, air, and suction in the insertion tube and in the universal tube are also crucial to the full functioning of the endoscope. These channel walls are similarly subject to the same aging and fatiguing factors as the flexible glass fibers. Additionally, the channel lumens are also subject to blockage, either from large debris from the patient or mineral deposits from dried water.

Small control cables also run from the control section through the insertion tube to bend the tip of the insertion tube as desired. These control cables are similarly subject to the same aging and fatiguing factors and must work properly for the endoscope to function.

In view of the above, it has been recognized in the prior art that the life of an endoscope is prolonged by proper storage. In general, it is recommended that air be aspirated through the suction channel (biopsy channel) to remove moisture. In addition, it is suggesed that the universal tube and insertion tube be kept as straight as possible, and if they must be bent for storage, not to bend them shorter than the radius of the carrying case provided.

One prior art rack for endoscopes is manufactured by Custom Endoscopy Design of Covington, Ky. This rack provides a series of wedge-shaped openings mounted parallel to a wall so that a plurality of endoscopes are hung thereon. The insertion tube is passed downwardly through the opening until the control section becomes wedged in the opening. Unfortunately, the wedging of the control section occurs at different angles so that some angulation of the insertion tube and subsequent fatiguing is allowed. In addition, the universal tube which extends perpendicularly from the control section is unsupported and subject to significant fatigue as it hangs vertically from the control section without support.

Another prior art endoscope rack is manufactured by KEYMED INC. This rack includes a rest for the control section which is parallel to the wall and at a 45° angle. The portion of the universal tube immediately adjacent the control section contacts the top of the rest. The universal tube is then looped back to the bottom of the rest and control section where the universal tube is locked in place. The insertion tube hangs freely from the control section. With this rack, no support is provided for the universal tube or insertion tube and, due to the angle at which the control section is maintained, both the universal tube and insertion tube are angulated so that fatigue easily results. In addition, by looping the universal tube, any moisture which is not removed collects at the low point of the universal tube and mineral deposits result due to evaporation of this collected moisture.

Various other racks for tools and instruments have also been disclosed in the prior art. Among these are the devices shown in the following U.S. Pat. Nos. 2,943,833 (Ramse), 3,941,412 (Carpenter), 4,262,800 (Nethercutt), 3,165,286 (Johnson et al.); and 3,004,673 (Emery).

SUMMARY OF THE INVENTION

A rack for the proper storage of an endoscope is provided. The endoscope typically includes an elongate control section, an insertion tube extending longitudinally from a lower end of the control section and an universal tube extending laterally from an upper end of the control section. The rack of the present invention includes a planar base which is disposed generally vertically so as to have a top edge, a front edge, a bottom edge, and a rear edge. An irregularly shaped rest extends generally perpendicularly from one face of the base. The rest includes a generally straight front portion which extends upwardly from an area adjacent the bottom edge and front edge to a position below the top edge, and a generally convex portion which extends downwardly from the upper end of the front portion to an area adjacent the bottom edge and rear edge. A vertically disposed planar cover is spaced from the planar base by the rest. The cover extends vertically above the rest so that a holder for the endoscope is provided. The endoscope is held in the rack with the control section resting against the front portion so that the insertion tubes hangs substantially vertically from the control section. The universal tube is draped over the convex portion so that that portion of the universal tube is positively supported while the remainder of the universal tube hangs substantially vertically. The weight of the scope is primarily supported adjacent the surface of the convex portion immediately adjacent to the front portion. This corresponds to the balance point of the scope.

In the preferred embodiment, the convex portion also includes a top portion which extends for a short distance from the upper end of the front portion. This top portion is precisely conformed to the corresponding shape of the endoscope which rests thereon and is somewhat offset from horizontal so as to be inclined downwardly from the front edge to the rear edge. The front portion is further somewhat offset from vertical so as to be inclined toward the back edge. Preferably, a somewhat obtuse angle is formed between the front portion and the top portion.

Typically, the endoscope control section is wider than the diameter of the universal tube. Therefore, in the preferred embodiment, the cover is spaced from the base adjacent the front portion of the rest by a distance somehwat larger than the width of the control section. The cover is then spaced from the base adjacent the convex portion by a distance somewhat larger than the diameter of the universal tube. In this manner, the control section and universal tube are snuggly received between the base and cover.

Where a number of accessories are also provided with the endoscope, the present invention also includes a holding means for these accessories. The holding means extends from the other face of the base, opposite the side on which the rest is located. Preferably, an attaching means is also provided for attaching the base to a wall so that the rear edge of the base is adjacent the wall and the front edge is spaced from the wall. Conveniently, the base forms an angle with the wall of 45° to 90°.

Where it is desired to store a plurality of endoscopes, the present invention further includes a corresponding plurality of racks arranged laterally adjacent one another along the wall. Conveniently, the plurality of the racks includes a base with a rest, cover, and attaching means, only, at one lateral end and a base with a holding means and attaching means only at the other lateral end.

It is also an advantage of the present invention that most of the weight of the endoscope is supported at the balance point of the endoscope.

It is an advantage of the present invention that an endoscope is positively and snuggly stored with the insertion tube hanging substantially vertically from the endoscope. In addition, the portion of the universal tube adjacent the control section is smoothly draped over the convex portion of the rest so that the remainder of the universal tube hang substantially vertically. With this construction, almost no angulation of the universal tube or insertion tube is allowed which can cause fatigue in the various channels, glass fibers, and wires contained therein. In addition, no loops are provided in the tubes so that any moisture remaining in the tubes drains easily therefrom and does not and create deposits in the tubes.

It is a further advantage of the present invention that the endoscope is stored along the wall while using a minimum of lateral space along the wall. In addition, the accessories are similarly stored adjacent the endoscope.

Still another advantage of the present invention is that a plurality of endoscopes can be stored in a small lateral area of the wall using a plurality of racks.

Other features and advantges of the present invention are stated in or apparent from a detailed description of a presently preferred embodiment of the invention found hereinbelow.

DETAILED DESCRIPTION OF THE PREFERRED EMBODIMENT

Figure 5:
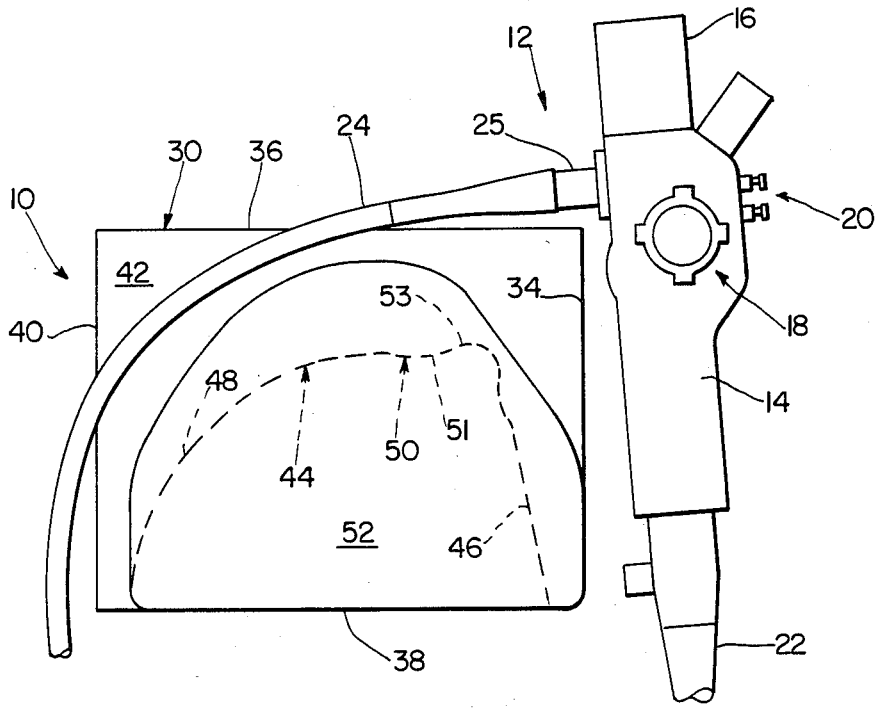
FIG. 5 is a left plan view of a rack according to the present invention with an endoscope about to be mounted thereon.

With reference now to the drawings in which like numerals represent like elements throughout the several views, a presently preferred embodiment of a rack 10 for an endoscope 12 is depicted in FIGS. 1 to 6. With reference to FIG. 5, it should be appreciated that endoscope 12 typically includes a control section 14 having a generally elongate shape which is easily grasped by the user. Control section 14 includes an eyepiece 16, tip angulation control 18, and water, air, and suction controls 20. Extending longitudinally from control section 14 on the opposite side of eyepiece 16 is an insertion tube 22. Extending laterally from control section 14 adjacent eyepiece 16 is an universal tube 24. The balance point 25 of endoscope 12 is located on universal tube 24 immediately adjacent control section 14. As is well known in the art, the distal end of universal tube 24 is connected to a suitable source of light, suction, water, and air which is conducted through control section 14 to insertion tube 22. Insertion tube 22 is inserted into the patient during use, and the view at the tip end of insertion tube 22 is seen through eyepiece 16.

As shown best in FIGS. 1 to 4, rack 10 includes a planar base 30 which is disposed substantially vertically. Planar base 30 forms an angle with a wall 32 in a range of 45° to 75° with the preferred angle being approximately 60°. Planar base 30 is generally rectangular shaped and includes a front edge 34, top edge 36, bottom edge 38, and rear edge 40.

Extending generally perpendicularly from one face 42 of planar base 30 is an irregularly shaped rest 44. As shown best in FIGS. 3 and 4, irregularly shaped rest 44 includes a front portion 46 extending upwardly from an area adjacent the bottom edge 38 and front edge 34 to a position below top edge 36. Front portion 46 is generally straight and is preferably disposed at an angle to vertical so as to be inclined somewhat towards rear edge 40. The inclination of front portion 46 is in the range from 5° to 20° and is preferably about 13°.

Rest 44 also includes a generally convex portion 48 which extends from the upper end of front portion 46 downwardly toward an area adjacent bottom edge 38 and rear edge 40. Convex portion 48 includes a short top portion 50 immediately adjacent front portion 46. Top portion 50 is somewhat offset from horizontal so as to be generally inclined downwardly from the upper end of front portion 46 toward rear edge 40. Preferably, the angle which top portion 50 makes with horizontal is from about 1° to 10°. Top portion 50 is precisely conformed to the mating portion of universal tube 24, especially at balance point 25. Thus, top portion 50 includes a slight hump 51 which is precisely conformed to mate with balance point 25 and a light dip 53 which conforms to the remainder of universal tube 24 adjacent balance point 25. It should be appreciated that top portion 50 and front portion 46 is somewhat differently configured for different endoscope brands or models.

A planar cover 52 is spaced from planar base 30 by rest 44. Planar cover 52 is also generally vertically disposed and extends from an area adjacent bottom edge 38 to a position vertically above rest 44. As shown best in FIG. 1, planar cover 52 is not parallel to planar base 30. Instead, planar cover 52 is spaced from planar base 30 by a greater distance adjacent front portion 46 than at the position adjacent convex portion 48. The actual distance which planar cover 52 is spaced from planar base 30 adjacent front portion 46 is somewhat greater than the width of control section 14. The actual distance which planar cover 52 is spaced from planar base 30 adjacent convex portion 48 is slightly larger than the diameter of universal tube 24, which it should be appreciated is less than the width of control section 14.

Endoscope rack 10 is also provided with a holder 60 for the various endoscope 12 accessories. Holder 60 includes a top member 62 which extends from top edge 36 horizontally away from planar cover 52. As shown best in FIG. 1, top member 62 is triangularly shaped and includes a holding portion 64 which extends generally perpendicularly from wall 32. A plurality of horizontally opened holes 66 are provided along the length of holding portion 64 so that flexible biopsy forceps (not shown) and the like can be hung therefrom. A supporting member 68 extending from front edge 34 of planar base 30 rearwardly upon which top member 62 rests is also provided. A peg 70 extending from supporting member 68 is additionally provided for holding an appropriate accessory.

Rear edge 40 of planar base 30 as well as the corresponding parallel edges of top member 62 and supporting member 68 are securely attached to a mounting member 72. Mounting member 72 is used to mount endoscope rack 10 to wall 32 using a suitable means (not shown) such as screws or the like. Conventiently, endoscope rack 10 can be integrally formed of a plastics material.

Figure 6:
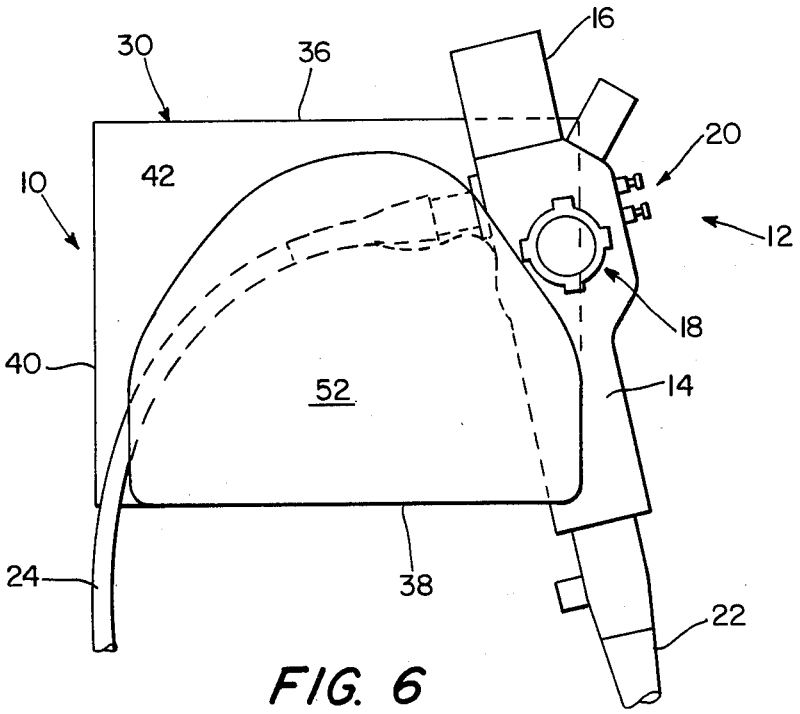
FIG. 6 is a left plan of the rack depicted in FIG. 5 with the endoscope mounted thereon.

In operation, endoscope rack 10 functions in the following manner. Initially, rack 10 is appropriately mounted on wall 32 or the like by attaching mounting member 72 thereto. It should be appreciated that rack 10 should be mounted to wall 32 at a height greater than the length of insertion tube 22 and universal tube 24. Once in place, endoscope 12 is simply and securely stored on rack 10 as shown in FIGS. 5 and 6. As shown in FIG. 5, control section 14 is initially located in front of front portion 46 while universal tube 24 is located vertically above convex portion 48. By simply moving endoscope 12 forward and downward, control section 14 is snuggly received between planar base 30 and planar cover 52 while resting against front portion 46. Similarly, universal tube 24 is snuggly received between planar base 30 and planar cover 52 while resting against convex portion 48.

As shown best in FIG. 6, once endoscope 12 is in place on rack 10, insertion tube 22 hangs substantially vertically from control section 14 so that virtually no angulation forces are exerted on insertion tube 22 to fatigue insertion tube 22. In addition, universal tube 24 is subject only to a gently bending as it extends initially substantially straight from control section 14 along top portion 50 and then curved gently along the remainder of convex portion 48. Finally, the remainder of universal tube 24 hangs vertically from the end of convex portion 48. In this manner, no substantial angulation is exerted on universal tube 24 so that no fatiguing forces are created.

It should also be appreciated that endoscope 12 is positively held in rack 10 around the corner provided between top portion 50 and front portion 46 by the hanging weights of universal tube 24 and insertion tube 22. In addition, most of the weight of endoscope 12 is supported through balance point 25 against hump 51 and the portion of universal tube 24 adjacent balance point 25 is matingly resting against top portion 50. The various accessories provided with endoscope 12 are further conveniently hung immediately adjacent endoscope 12 along holding portion 64.

The use of rack 10 also assures that any moisture contained in insertion tube 22 or universal tube 24 will drain therefrom as tubes 22 and 24 hang vertically. A minimum of wall space is also taken up by rack 10 even though endoscope 12 and the various accessories are readily visible and accessible.

Figure 1:
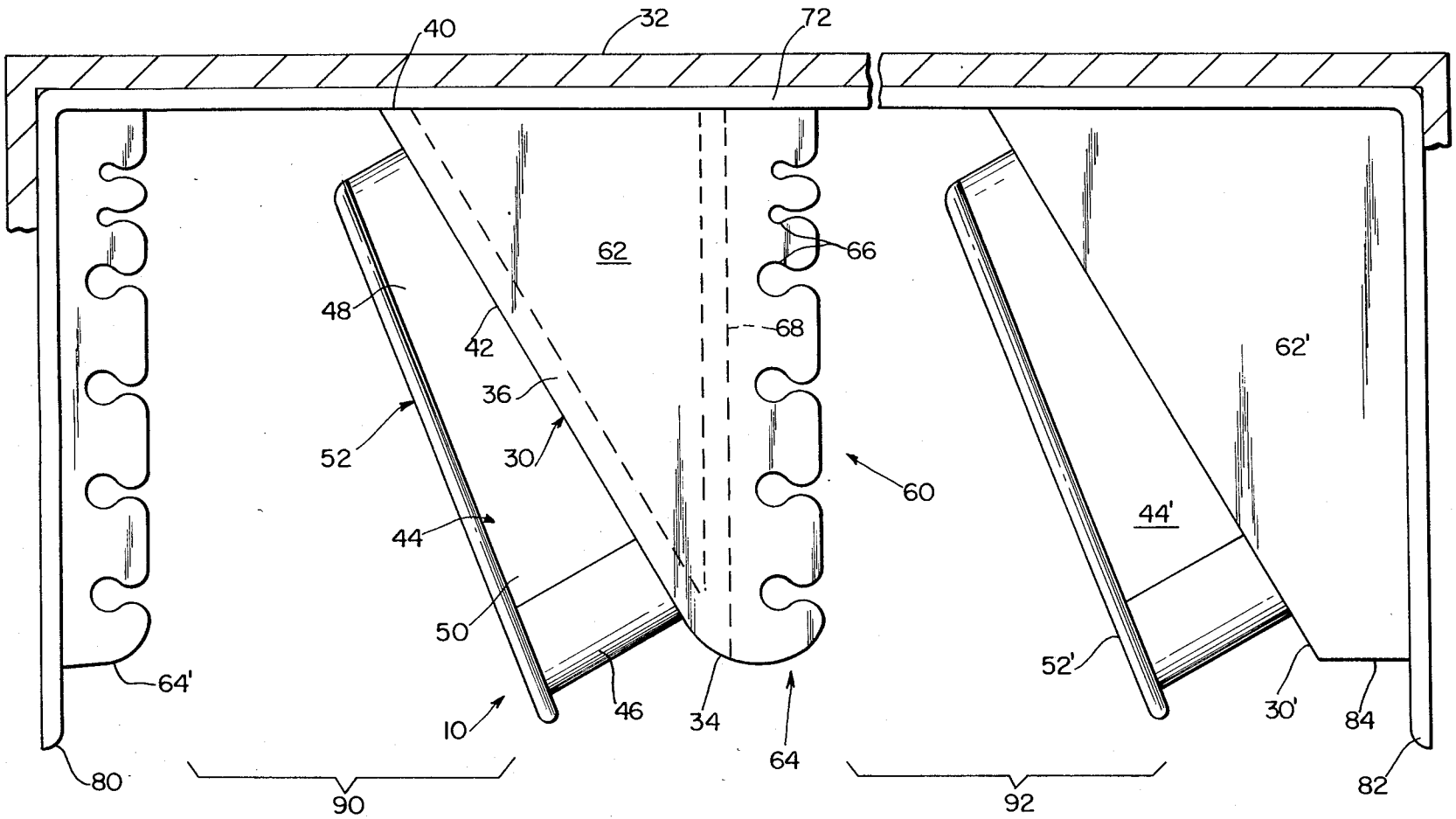
FIG. 1 is a top plan view of a rack according to the present invention.
Figure 2:
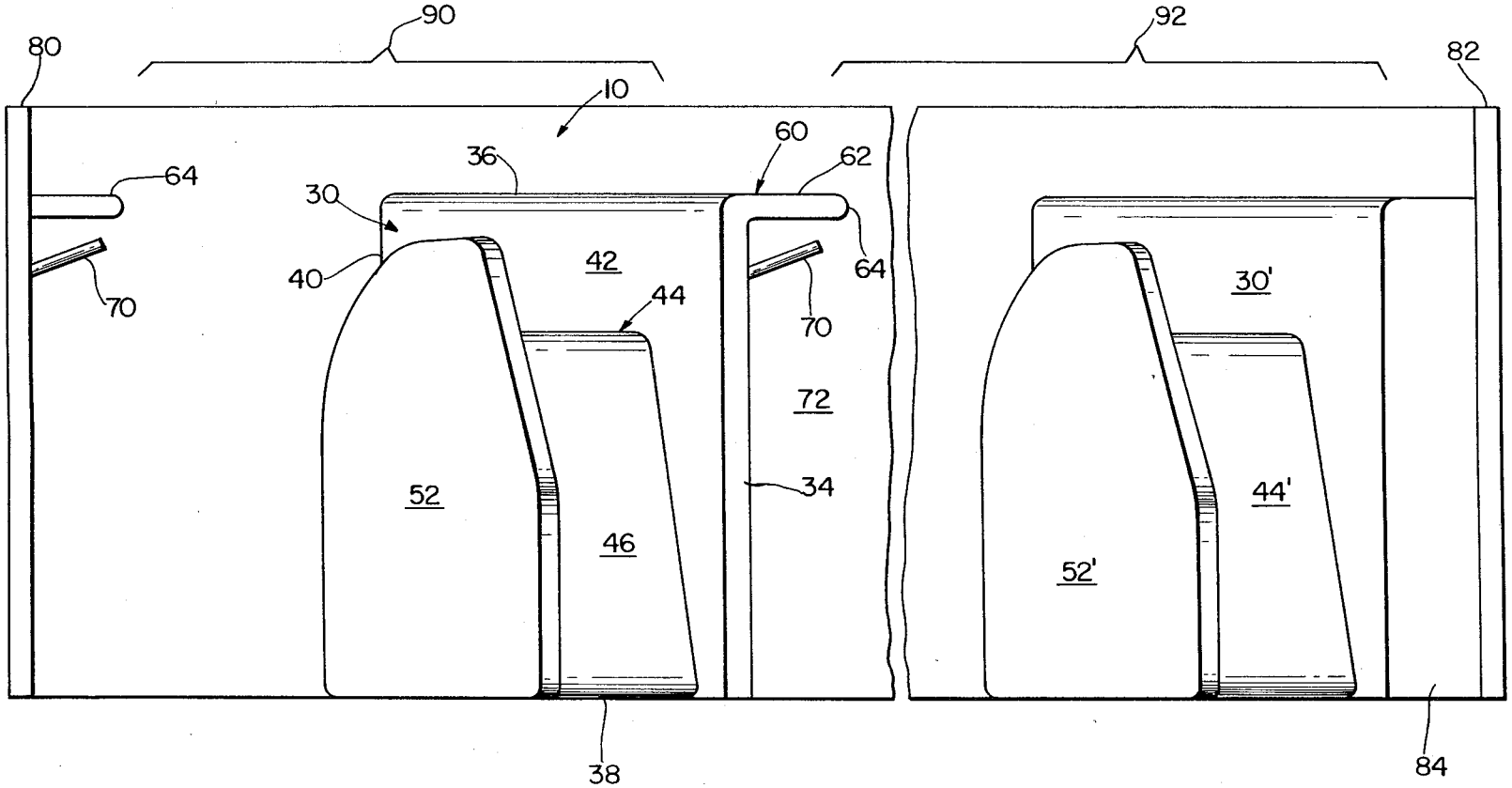
FIG. 2 is a front elevation view of the rack depicted in FIG. 1.
Figure 4:
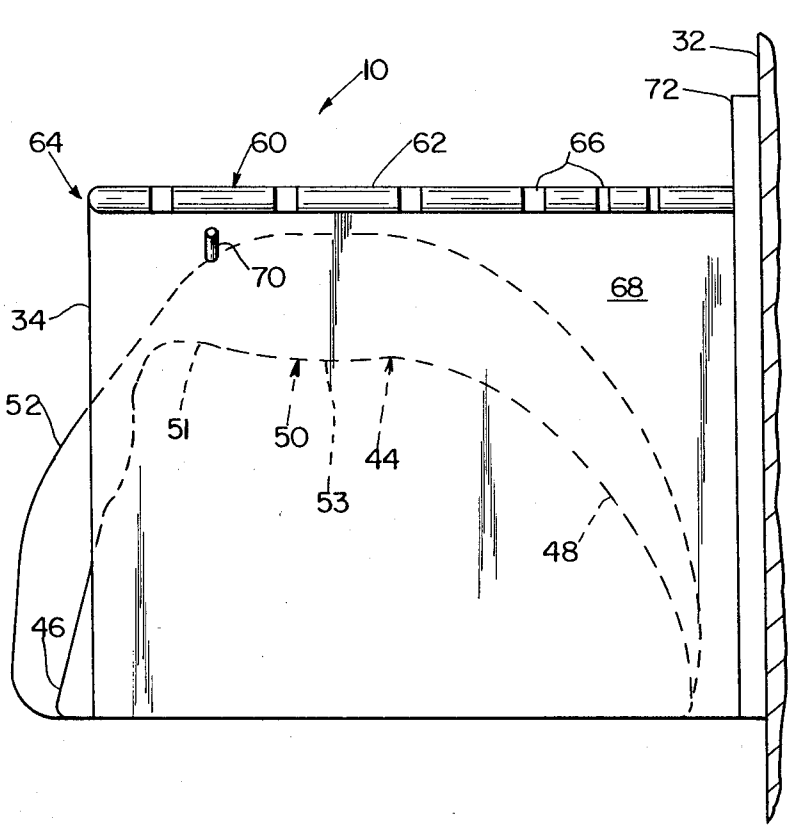
FIG. 4 is a right plan view of the rack depicted in FIG. 2.
Figure 3:
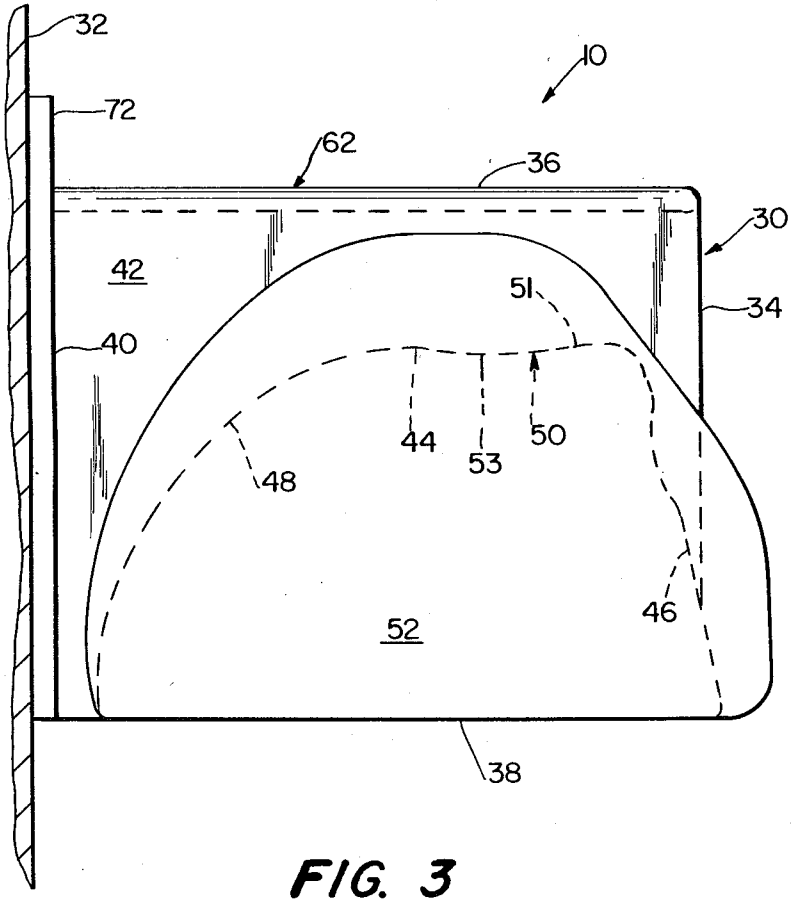
FIG. 3 is a left plan view of the rack depicted in FIG. 2.

As shown in FIGS. 1 and 2, it is possible to arrange a plurality of racks 10 in a series. Frequently, such a series of racks 10 is mounted on the rear wall of a cabinet. When this occurs, mounting member 72 further includes side members 80 and 82. Side members 80 and 82 are attached to the side walls of the cabinet to further support the racks.

Where racks 10 are used in a cabinet, side member 80 is provided with a holding portion 64' and a peg 70' as shown. On the other side, side member 82 is provided with a planar base 30', a rest 44', and planar cover 52'. As shown, planar base 30' is attached to side member 82 by a top member 62' and front member 84. With this construction, a number of distinct rack bays such as rack bays 90 and 92 are provided in which a suitable endoscope and accessories are mounted. Thus, rack bay 90 includes the endoscope mounting portion of rack 10 and accessory holding portion 64'. In a similar manner, rack bay 92 includes the endoscope rack formed by rest 44' and accessory holding portion 64. This construction allows the maximum use of the storage area in the cabinet.

Although holding portion 64 has been depicted as extending substantially vertically from mounting member 72, it should be appreciated that holding member 64 could be disposed at an angle to mounting member 72 in the same manner that planar base 30 is mounted at an angle to mounting member 72.

Thus, it should be appreciated that variations and modifications can be effected within the scope and spirit of the invention.

What is claimed is:

1. A rack for storing an endoscope, the endoscope having a control section of generally elongate shape, an insertion tube extending longitudinally from one end of the control section, and a universal tube adjacent the end of the control section opposite said one end, said rack comprising:

a planar base which is disposed generally vertically in use such that said base has a top edge, a front edge, a bottom edge, and a rear edge, said base including a pair of possed faces;

an irregularly shaped rest extending generally perpendicularly from one of said faces of said base and including;

(a) a generally straight front portion extending upwardly from an area adjacent the bottom edge and the front edge of the planar base, and having an upper end disposed below the top edge of the planar base, and (b) a generally convex portion extending downwardly from the upper end of said front portion to an area adjacent the bottom edge and the rear edge of the planar base; and a generally vertically disposed planar cover spaced from said planar base by said rest, said cover extending vertically above said rest such that a holder for the endoscope is provided with the control section resting against said front portion whereby the insertion tube hangs substantially vertically from the control section and with the universal tube draping over said convex portion whereby the remainder of the universal tube hangs substantially vertically.

2. A rack for storing an endoscope as claimed in claim 1 wherein the endoscope has a balance point on the universal tube immediately adjacent the control section; and wherein said convex portion includes a top portion extending for a short distance from the upper end of said front portion, said top portion being precisely configured to mate with the portion of the universal tube adjacent the balance point to support most of the weight of the endoscope through the balance point.

3. A rack for storing an endoscope as claimed in claim 2 wherein said top portion is offset somewhat from horizontal so as to be inclined downwardly from the front edge to the rear edge.

4. A rack for storing an endoscope as claimed in claim 2 wherein said front portion is somewhat offset from vertical so as to be inclined toward the rear edge of said planar base.

5. A rack for storing an endoscope as claimed in claim 4 wherein the endoscope control section is wider than the diameter of the universal tube, and wherein said cover is spaced from said base adjacent said front portion of said rest by a distance somewhat larger than the width of the control section and said cover is spaced from said base adjacent said convex portion of said rest by a distance somewhat larger than the diameter of the universal tube such that the control section and universal tube are snuggly received between said base and said cover.

6. A rack for storing an endoscope as claimed in claim 5 wherein said front portion of said rest is inclined from vertical at an angle of 5° to 20°.

7. A rack for storing an endoscope as claimed in claim 6 wherein said top portion is inclined from horizontal at an angle of 1° to 10°.

8. A rack for storing an endoscope as claimed in claim 1 and further including a holding means extending from the face opposite said one face of said base for holding accessories of the endoscope.

9. A rack for storing an endoscope as claimed in claim 8 and further including an attaching means for attaching said base to a wall such that the rear edge of said base is adjacent the wall and the front edge is spaced from the wall.

10. A rack for storing an endoscope as claimed in claim 9 wherein said base forms an angle with the wall of 45° to 90° such that said cover faces away from the wall.

11. A rack for storing an endoscope as claimed in claim 10 wherein said base, said rest, and said holding means are integrally formed of a plastics material.

12. A rack for storing an endoscope as claimed in claim 10 wherein a plurality of endoscopes and accessories are supported, and further including a corresponding plurality of said racks arranged laterally adjacent one another along a wall whereby the endoscopes and accessories are stored using a minimum of lateral wall space.

13. A rack for storing an endoscope as claimed in claim 12 wherein the plurality of said racks includes a base with a rest, a cover and an attaching means only at one lateral end and a base with a holding means and an attaching means only at the other lateral end.

14. A rack for storing an endoscope as claimed in claim 5 an further including a holding means extending from the face opposite said one face of said base for holding accessories of the endoscope, and an attaching means for attaching said base to a wall such that the rear edge of said base is adjacent the wall and the front edge is spaced from the wall whereby said base forms an angle with the wall of 45° to 90°.

* * * * *